United States Patent [19]

Mathis et al.

[11] 4,249,323

[45] Feb. 10, 1981

[54] VARIABLE WING PLOW BLADE AND MOUNTING STRUCTURE THEREFOR

[75] Inventors: Robert D. Mathis, Salt Lake City; Gordon Hine, Logan, both of Utah

[73] Assignee: De Lorean Manufacturing Company, Bloomfield Hills, Mich.

[21] Appl. No.: 916,613

[22] Filed: Jun. 19, 1978

[51] Int. Cl.[3] ..... D06F 71/00; E02F 3/76

[52] U.S. Cl. ..... 37/42 R; 172/804; 172/815; 172/820

[58] Field of Search ..... 37/41, 42 R, 42 VL, 37/50; 172/782, 786, 788, 801-807, 809, 777

[56] References Cited

U.S. PATENT DOCUMENTS

| | | | |
|---|---|---|---|
| 2,224,725 | 12/1940 | Felt, Jr. | 172/804 |
| 2,565,337 | 8/1951 | Allan | 172/804 |
| 2,749,630 | 6/1956 | Nave | 172/804 |
| 3,529,678 | 9/1970 | Teasdale | 172/809 X |
| 3,773,116 | 11/1973 | Coontz | 172/804 |
| 4,034,815 | 7/1977 | Dezelan | 172/809 |
| 4,099,578 | 7/1978 | Stevens | 172/802 |

FOREIGN PATENT DOCUMENTS

| | | | |
|---|---|---|---|
| 155899 | 8/1952 | Australia | 172/803 |

*Primary Examiner*—E. H. Eickholt
*Attorney, Agent, or Firm*—A. Ray Osburn

[57] ABSTRACT

A variable wing plow blade and mounting structure for attaching the plow blade to a tractor, snow grooming vehicle, and the like feature distribution of the load on the blade over a relatively wide area of the supporting structural members thereby to permit reduction in their size, weight and number and in their manufacturing and assembling costs while maintaining the essential structural strength, and are further characterized in the attainment of improved performance and utility in respect of independence of the plow blade height and pitch or roll, tilt and wing blade adjustments, and greater freedom of movement of the wing blades of the plow blade, both forwardly and rearwardly, from a position of alignment with the center section of the plow blade.

21 Claims, 16 Drawing Figures

VARIABLE WING PLOW BLADE AND MOUNTING STRUCTURE THEREFOR

BACKGROUND OF THE INVENTION

1. Field of the Invention

The invention relates to an improved material handling or treating plow blade and mounting structure therefor that are attachable to a tractor, snow grooming vehicle, and similar self-propelled vehicles. The plow blade may be a scraper blade, a snow plow blade, or other plow blade for which, in operation, there is required adjustability in the height of the blade above the terrain, and adjustability, also, in the cutting angle or angle of attack of the blade in three dimensions, that is along three separate pivotal axes each of which is spaced 90° from the others.

2. Description of the Prior Art

Different forms of mounting structures for material handling or treating plow blades have been proposed in the prior art for providing height and three dimensional blade adjustability. One form disclosed in U.S. Pat. No. 3,157,099, granted Nov. 17, 1964, utilizes a C-frame pivotally mounted on a tractor and a two-section plow blade, a three-section plow blade being suggested but neither illustrated nor otherwise described, attached at a vertically hinged connection of the blade sections by a pivot pin or pintle to the C-frame, the pintle extending centrally and longitudinally of the tractor. The main thrust of the load on the plow blade is connected on the pintle connection to the C-frame. Therefore, in order to provide the essential strength the C-frame necessarily must be massive and heavy. As a result, the mounting structure is costly to manufacture and difficult to assemble. Moreover, special hydraulically actuated rams are needed to support and adjust the ends of the plow blade sections, further adding undesirably to the difficulty and cost of manufacture and assembly.

Another form of mounting structure for a material treating plow blade is disclosed in U.S. Pat. No. 3,822,751, granted July 9, 1974. The structure there shown provides, for a single section plow blade, adjustability in height and cutting angle in three planes, and comprises an assembly of five different frames that are pivotally connected to each other, the connection of the second and third frames to each other being by a single centrally located vertically disposed pivot carried at the vertex of a triangular portion of the second frame. The first frame is attached to a tractor and the fifth frame to the plow blade. Here, too, the main thrust of the load on the plow blade is concentrated on a single pivot, the vertically disposed pivot connection between the second and third frames. This requires those frames, particularly, to be massive and heavy, adding further to the difficulty and cost of manufacture and assembly of a complex assortment of frames.

While the mounting structures of U.S. Pat. Nos. 3,157,099 and 3,822,751 both provide for height and three dimensional adjustability of the plow blade, the structures are such that adjustment of the blade height, in each case, undesirably alters the pitch or roll angle of the blade. Accordingly, a compensating pitch angle adjustment is required whenever the height of the blade is changed if the optimum pitch angle for the resistance characteristics of the material being handled or treated is to be maintained.

Three-section forms of plow blades for attachment to a tractor are disclosed in U.S. Pat. Nos. 3,477,151, granted Nov. 11, 1969 and 4,019,268, granted Apr. 26, 1977. Specifically, Pat. No. 3,477,151 shows a snow plow comprising a center or primary blade and two wings or flanking auxiliary blades, each pivotally connected about an upright or vertical axis at an associated end of the center blade, the manner of attachment of the snowplow to a self-propelled vehicle not being shown. The wing blades are connected for simultaneous limited inverse pivotal movement with respect to the center blade, from relative positions wherein one wing blade is aligned with the center blade when the other is at an angle rearward of less than 180° therewith. Forward pivotal movement of the wing blades with respect to the center blade is not permitted.

U.S. Pat. No. 4,019,268 shows a three-section plow blade for snow compacting equipment in which the blade is pivotally secured to a vehicle by first and second frames parallel to the blade and by a pair of third frames that extend normal to the second frame. The three-section blade includes a center blade and two wing blades, each pivotally connected to an associated end of the center blade. The pivotal connections are horizontal whereby the wing blades, when actuated relatively to the center blade, pivot upwardly. This facilitates transportation of the equipment to and from ski trails and for storage when not in use. The structure does not provide for either downward, rearward or forward pivotal movement of the wing blades with respect to the center blade.

Accordingly, there still exists a need for improvements in the mounting structures or assemblies for plow blades, particularly in respect to an arrangement for a plow blade having variably adjustable wings: (a) that simplifies the construction and reduces the size and weight of the components while maintaining the essential structural strength, reduced the number of component parts and their manufacturing and assembly cost; (b) wherein the height adjustment of the plow blade is substantially independent of the cutting angle adjustments thereof, and in particular, the pitch or roll angle adjustment; and (c) wherein the adjustable wings of the plow blade have greater freedom of movement independently of each other, including forward as well as rearward pivotal movement with respect to the center blade.

SUMMARY OF THE INVENTION

Among the objects of the invention is the provision of a variable wing plow blade and mounting structure therefor for attachment to tractors and similar self-propelled vehicles that avoids the problems and limitations of the prior art plow blades and mounting structures.

Another object of the invention is to provide such a variable wing plow blade and mounting structure therefor that is less expensive to manufacture and to assemble.

Another object of the invention is to provide an improved and simplified mounting structure for a variable wing plow blade wherein the load on the blade is distributed over a substantial area of the supporting components of the mounting structure whereby the size and weight of the components may be reduced while maintaining rigidity and structural strength, and wherein more strength is provided where the structure mounts to the vehicle chassis.

A further object of the invention is to provide such an improved mounting structure for a variable wing plow blade that provides a plurality of independent adjustments of the blade in three dimensions, including a height adjustment of the blade that is substantially independent of and does not adversely affect any of the other adjustments.

Still another object of the invention is to provide such an improved mounting structure for a variable wing plow blade that provides freedom of movement of the wing blades, selectively and independently of each other, both forwardly and rearwardly of the center blade.

Another object of the invention is to provide such an improved mounting structure for a variable wing plow blade that includes a plurality of control means, and particularly, hydraulic motor means, thereby to enable the vehicle operator to make the various plow blade adjustments from a readily accessible control panel in the cab.

Yet another object of the invention is to provide such an improved mounting structure for a variable wing plow blade wherein the hydraulic motor means includes relief valve means to prevent damage to the plow blade in the event either wing hits an immovable object.

In accomplishing these and other objects of the invention, there is provided a mounting structure or assembly for attaching a plow blade having a center blade and variably adjustable wing blades to a vehicle such as a tractor, snow grooming vehicle, or the like. The mounting structure includes a first horizontally positioned rectangular mount frame that is pivotally attached at one end by a pivot mount to the vehicle. The mount frame extends forwardly of the vehicle from a position adjacent the front axle thereof. The mounting structure further includes a second horizontally positioned rectangular push frame that is rigidly attached at the rearward end thereof to the forward end of the first frame. For convenience hereinafter the first and second frames are designated first frame means. The forward end of the first frame means is pivotally attached by first connecting means to a second frame means, a generally vertically positioned rectangular mounting frame, at a position adjacent the lower edge of the latter. The second frame means includes a pair of spaced vertically extending members and a lower horizontal cross member on which three spaced vertical posts are mounted. The cross member and posts are positioned in a plane that is forward of the general vertical plane of the second frame means. The center blade of the plow is attached to the cross member by means designated second connecting means and to the posts by third connecting means. The cross member and posts provide support for the center blade of the plow over a substantial portion of the rear surface thereof, the third connecting means restraining movement therebetween except for limited relative tilting of the center blade about a pivotal axis provided by said second connecting means.

The mounting structure according to the invention further includes control means, specifically hydraulic motor means, so connected between the vehicle and the several frame means and between certain members of the frame means as to effect various adjustments of the plow blade in each of three dimensions, that is, along three separate pivotal axes that are spaced 90° apart, for convenience designated coordinate X, Y and Z axes. Each such adjustment is independent of the others including an adjustment of the height of the plow blade with respect to the vehicle and the terrain. One such pair of hydraulic cylinders is connected between the vehicle and the second frame means. These hydraulic cylinders, when actuated, raise or lower the forward end of the second frame means and thereby adjust the height of the plow blade about a horizontal transverse axis provided by the pivot mounts at the rear of the first frame means. The effective lever arm involved in making this adjustment is the combined length of the first and second frame means.

Another pair of hydraulic cylinders connected between the vehicle and the vertically extending members of the second frame means, when actuated, tip the second frame means and thereby the plow blade, backward or forward. This provides a pitch or roll adjustment of the plow blade. The pivotal axis of this adjustment is a horizontal transverse axis, for example, a Z—Z axis, located at the forward end of the first frame means. The invention features the use of extension arms in association with this pair of hydraulic cylinders of such length so positioned that each extension arm and the lever arm for raising or lowering the plow blade effectively comprise opposite arms of a parallelogram. Consequently, as those skilled in the art will understand, adjustment of the height of the plow blade is substantially independent of and does not adversely affect the pitch or roll adjustment of the plow blade.

A hydraulic cylinder connected between a sideward extending pivot arm or tongue on the second frame means and the plow blade center section, when actuated, tilts the center blade of the plow relatively to the second frame means about the axis of the pivot connection of these components, for example, a Y—Y axis, thereby to raise or lower the ends of the plow blade.

A pair of hydraulic cylinders connected between rearwardly extending pivot arms or tongues on the plow center blade and on each of the wing blades, when actuated, horizontally adjust the cutting angle of the wing blades with respect to the center blade, such adjustment of the wing blades being about a generally vertical hinge pivot connection of each wing blade to a respective end of the center blade, and being either forward or rearward with respect to the center blade. Each such adjustment is about an X—X axis and is selectively independent of the other.

The various hydraulic cylinders are actuatable from a readily accessible control panel provided in the cab of the vehicle. Additionally, relief valve means are provided in accordance with the invention to release the pressure in the hydraulic cylinders to prevent damage to the plow blade in the event either adjustable wing hits an immovable object thereby to prevent damage to the plow blade.

BRIEF DESCRIPTION OF THE DRAWINGS

A better understanding of the invention may be had from the following detailed description when read in connection with the accompanying drawings wherein.

DESCRIPTION OF THE PREFERRED EMBODIMENT

Figure 1:
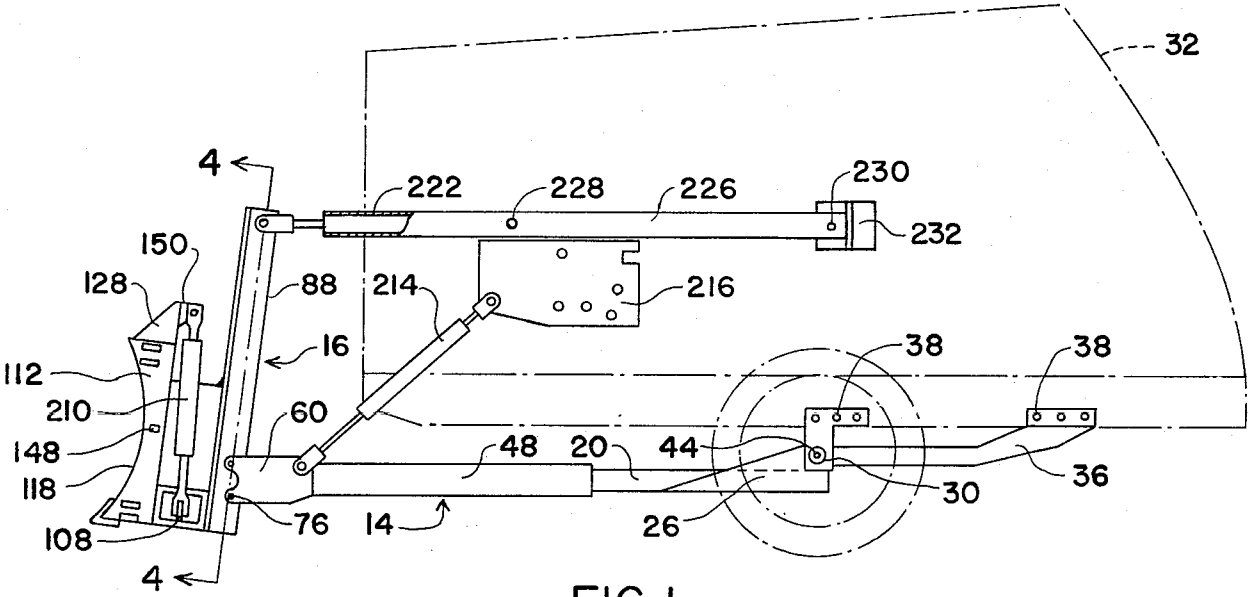
FIG. 1 is a side elevation of the mounting structure or assembly of the variable wing plow blade of the present invention, taken along the line 1—1 of FIG. 2 with a forward portion of a tractor added in dot-dash lines.
Figure 2:
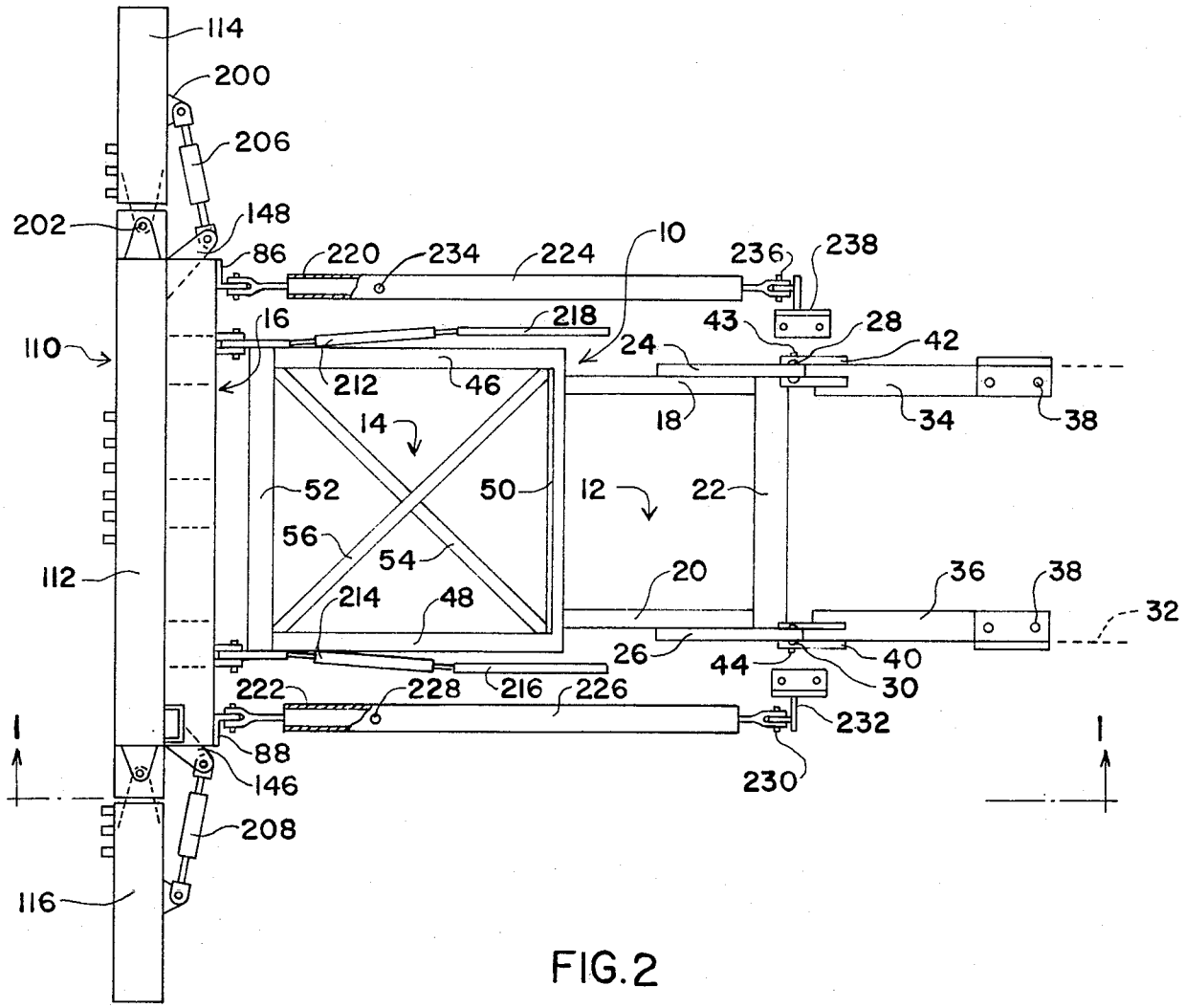
FIG. 2 is a top plan view of the mounting assembly and plow blade structural arrangement of FIG. 1 parts broken away.
Figure 3:
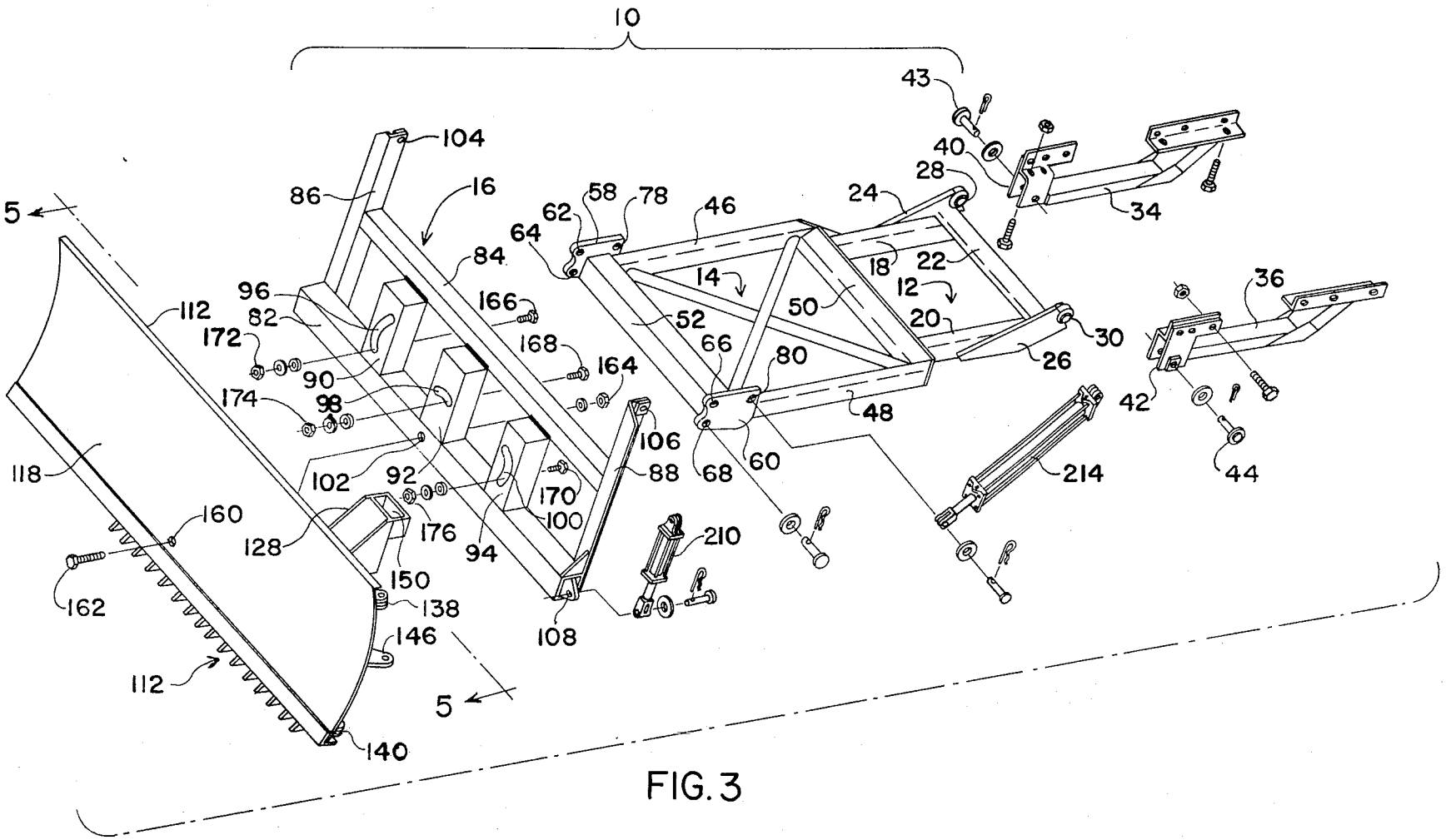
FIG. 3 is an exploded perspective view of the mounting assembly frame and plow blade arrangement of FIGS. 1 and 2, with the variable wing blade sections omitted.

Referring to FIGS. 1 to 3 of the drawings, the mounting structure or assembly, indicated generally by reference numeral 10, comprises a first frame 12, a frame 14, and a second frame means 16. The frames 12 and 14, collectively designated first frame means, constitute a unitary frame, and frame 16, designated a second frame means or mounting frame, are all rectangular in configuration and are formed of generally square tubular members. The first frame means 12, 14 are supported, in a manner to be described, in generally horizontal positions, the second frame means 16 being pivotally connected by first connecting means in a generally vertical position to the forward end of the first frame means 12, 14.

The first frame 12, includes side by side frame members 18 and 20 that are connected together at one end, the end facing toward the rear of the vehicle to which the assembly 10 is to be attached, by a cross or transverse member 22. Outboard of and connected to the side frame members 18 and 20 and cross member 22 are additional wedge shaped side frame members 24 and 26 that extend rearwardly and upwardly, slightly above cross member 22. Pivot bearings 28 and 30 are provided in the ends of side frame members 24 and 26, respectively, immediately above the cross member 22, for the pivotal attachment of the end of frame 12 to the vehicle chassis, indicated by dot-dash lines 32 in FIG. 1, by means of pivot mounts 34 and 36. Both ends of the pivot mounts 34 and 36 are bolted to the chassis 32, as by cap screws 38. The forward end of each pivot mount 34 and 36 is provided with a clevis, indicated, respectively, at 40 and 42, that cooperates with an associated bearing 28, 30 and pivot pin 43, 44 for the pivotal attachment of the side frame members 24 and 26 to the pivot mounts. This arrangement provides for movement of the first frame means 12, 14 and thereby the assembly 10, as will become apparent, about the axis of the pivot pins 43 and 44, an axis that is substantially horizontal and perpendicular to a longitudinal center line of the vehicle chassis 32.

Figure 4:
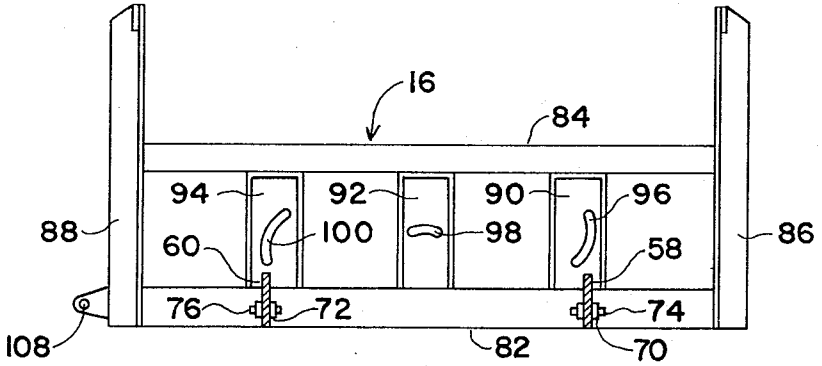
FIG. 4 is a rear elevation of the second frame means of the mounting assembly.

The frame 14 includes side by side frame members 46 and 48 that are connected at one end by a cross member 50 and at the other end by a cross member 52, and that are additionally connected by diagonal members 54 and 56. Projecting forwardly of the side frame members 46 and 48, one on either side of and outboard of cross member 52, are pivot mounts 58 and 60. These pivot mounts are provided for the pivotal attachment of the frame 14 to the second frame means 16. Pivot mounts 58 and 60 each includes a forwardly extending fork shaped portion in which two vertically spaced bearings 62, 64, and 66, 68, respectively, are provided. Pivot mounts 58 and 60 are each connected to an associated clevis 70, 72 that is provided at the rear of the second frame means 16, as seen in FIG. 4, by a respective pivot pin 74 and 76. The pairs of vertically spaced bearings 62, 66 and 64, 68, respectively, provide lower and upper pivot positions for the frame means 16 to the first frame means 12, 14. Pivot mounts 58 and 60 each further includes a respective bearing 78 and 80 for the attachment of motor means to be described for lifting and lowering first frame means 12, 14 and second frame means 16 about the horizontal axis of the pivot pins 43 and 44.

The second frame means 16, as seen particularly in FIGS. 3 and 4, includes a pair of vertically spaced generally horizontal cross members 82 and 84, a pair of elongated upstanding angle end members 86 and 88, and three intermediately located upstanding posts 90, 92 and 94, the horizontal members 82 and 84 being connected at their ends by the upstanding end members 86 and 88. Members 86 and 88 each have the form of a right angle and are inversely positioned with respect to each of members 82 and 84 as to present a side to each of said members, an edge of member 86 being presented to one side of frame 16 and an edge of member 88 to the other side of the frame. Thus, cross member 84 extends between a pair of facing sides of members 86 and 88 and the other sides of members 86 and 88 face the rear side of cross member 82, each such side being adjacent an associated end of member 82.

Each of the spaced posts 90, 92 and 94 is positioned on the upper surface of cross member 82, being ridigly connected thereto, and extends vertically for a distance such that the rear top edge of each post is adjacent the lower forward edge of cross member 84, being connected together, as by welding. The posts 90, 92 and 94 are each provided with an individual curved slot, indicated respectively at 96, 98 and 100, and the center of curvature of which is a pivot 102 provided at the center of an extending through the cross member 82 substantially parallel to a longitudinal center line of the vehicle chassis 32.

As seen in FIG. 3, particularly, pivot bearings 104 and 106 are provided at the extreme upper ends of arms 86 and 88, respectfully. Further, a pivot arm or tongue 108 is provided at the right end of cross member 82, the pivot arm in effect comprising an extension of member 82. The pivot bearings 104 and 106 and the pivot arm 108 comprise motor means connections for providing pitch angle and tilt angle adjustments of the variable wing plow blade in a manner to be described.

The variable wing plow blade, indicated generally by reference numeral 110, includes an elongation center blade or section 112, a right wing blade or section 114 and a left wing blade or section 116. The wing blades 114 and 116 are hinged on substantially vertical pivots to the right and left ends, respectively, of the center blade or section 112, in a manner to be described, for angular movement in a horizontal plane in both directions from a position of alignment with the center blade 112.

Figure 5:
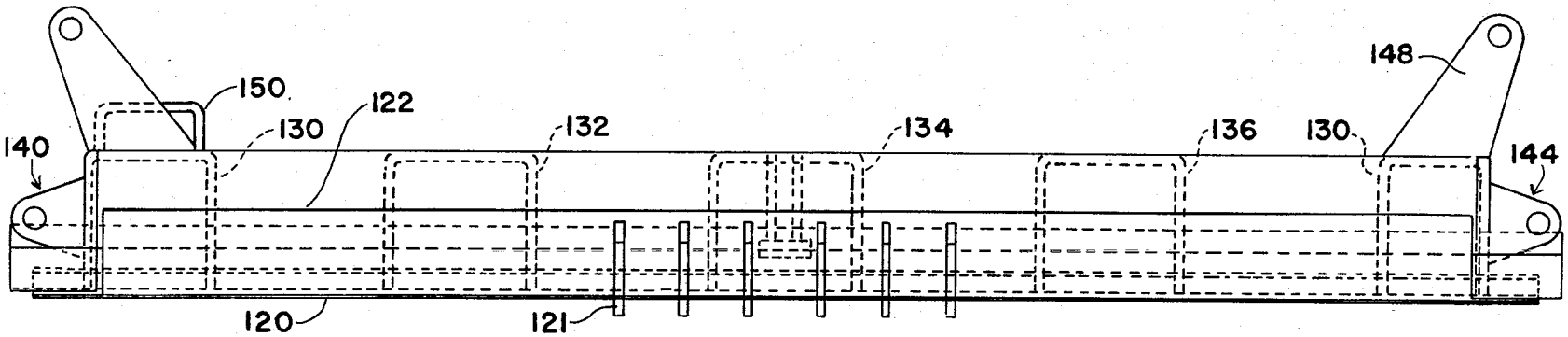
FIG. 5 is a bottom plan view of the center blade section of the variable wing plow blade.
Figure 6:
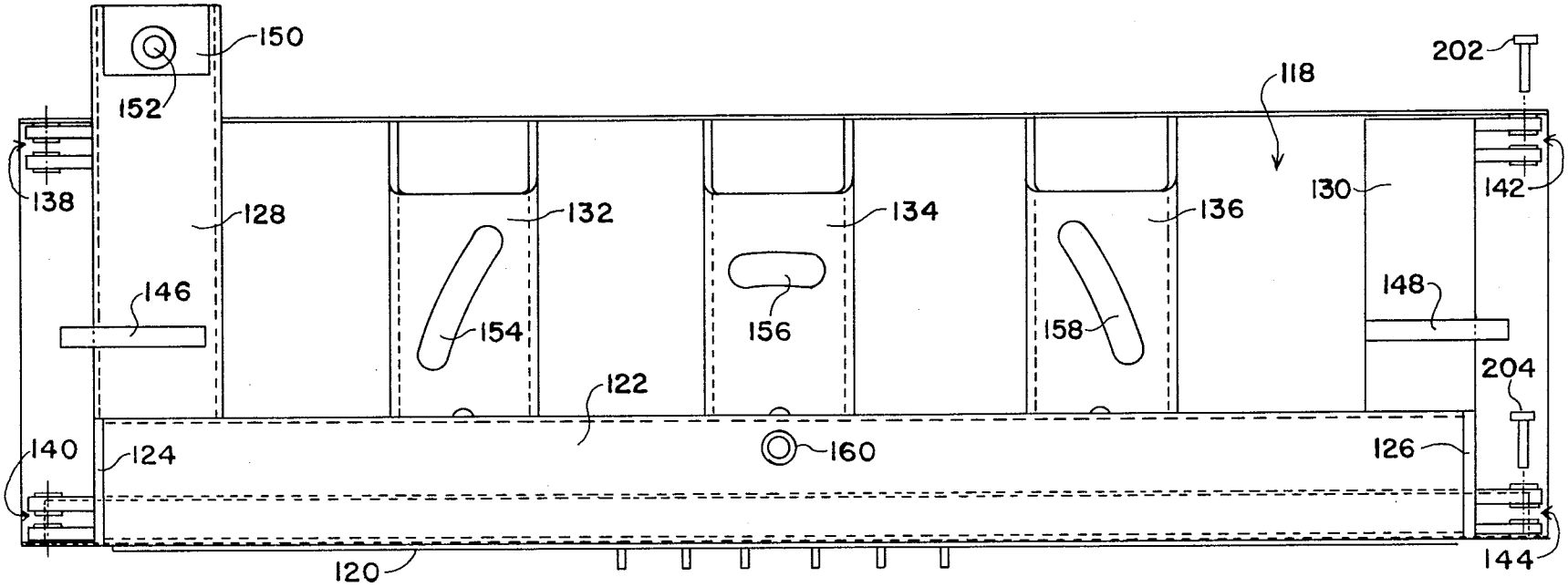
FIG. 6 is a diagrammatic rear view of the plow blade center section.
Figure 7:
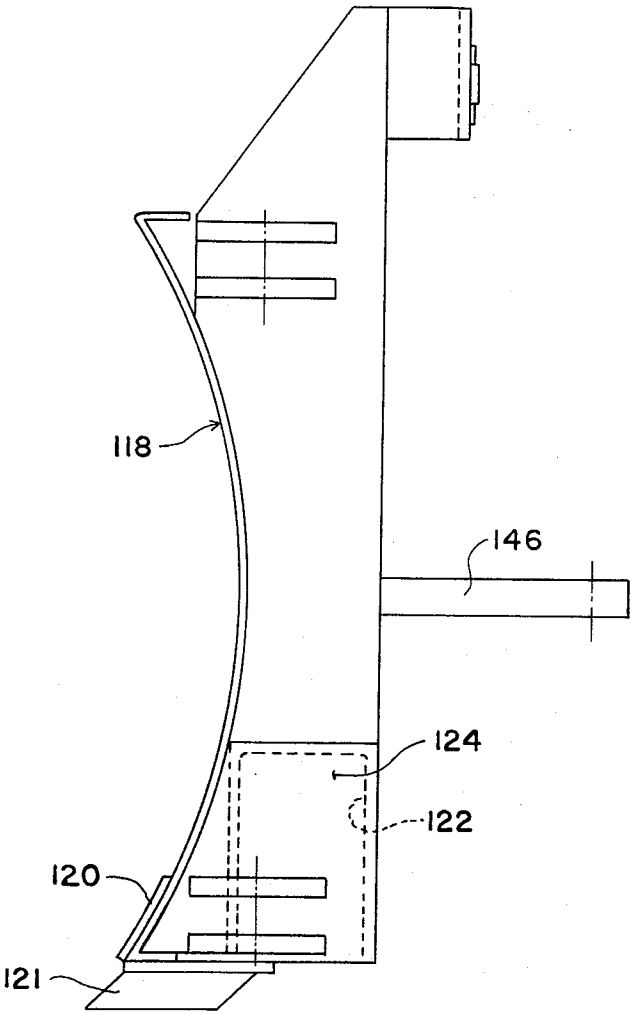
FIG. 7 is a diagrammatic end view of the plow blade center section as seen from the left in FIG. 6.

The plow blade center section 112, as illustrated in detail in FIGS. 5, 6 and 7, is comprised of a blade 118 having at its lower front or material engaging edge an elongated protective angle iron or wear bar 120 which may include a snow blade tooth 121, as indicated. The blade 118 is supported at the lower rear side thereof by a generally rectangular elongated tube 122 the ends of which are closed by plates 124 and 126. Supported on the upper surface of tube 122, at the left and right ends, respectively, as seen in FIG. 6, are upstanding U-shaped frame members 128 and 130. The tube 122 additionally supports on its upper surface, intermediate the ends thereof, three upstanding spaced U-shaped members 132, 134 and 136, the size and spacing of which may be substantially the same as that of the upstanding posts 90, 92 and 94 of the push frame 16.

The plow blade center section 112 further includes on its rear side, at the left and right ends thereof, as seen in FIG. 6, upper and lower sets of spaced rectangular hinge pads 138, 140 and 142, 144, and wedge shaped pivot mounts or tongues 146 and 148. Specifically, the upper sets of hinge pads 138 and 142 are attached to the outboard side of the respectively associated upstanding member 128 and 130, and the lower sets of hinge pads 140 and 144 are attached to the outboard side of the respectively associated elongated tube end plate 124 and 126. Pivot mounts 146 and 148 are attached, one adjacent each side of center section 112, to the rear side of an associated U-shaped member 128 and 130, each extending at an outward angle to the rear.

At the upper end of the U-shaped member 128, as seen particularly in FIGS. 5 and 6, there is provided an additional U-shaped member 150 that extends to the rear from member 128 and includes, centrally thereof, a bearing 152. The upstanding U-shaped members 132, 134 and 136 are each provided with an individual curved slot 154, 156 and 158, respectively, the curvature of the slots corresponding to that of the slots 100, 98 and 96 of the posts 94, 92 and 90 of the push frame 16. Additionally, the rectangular tube 122 is provided with a bearing 160 at a center portion thereof that is in alignment with the bearing 102 in the horizontal member 82 of the push frame when the plow center blade 118 positioned for proper support with respect to the push frame 16. With the center blade 112 so positioned, the rear surface of tube 122 abuts cross member 82, the rear surfaces of the U-shaped members 132, 134 and 136 abut the front surfaces of the posts 94, 92 and 90, and the slots 154, 156 and 158 are generally in alignment respectively, with the slots 100, 98 and 96.

As shown in FIG. 3, the plow blade center section 112 is pinned or bolted to the push frame 16 by a hex head cap screw 162 and uni-torque nut 164, a flat washer being provided, as suitable, these members, for convenience, being designated second connecting means. The plow blade center section 112 is also held to the push frame 16 by third connecting means, specifically hex head cap screws 166, 168 and 170 that extend, respectively, through the associated pairs of slots 96 and 158, 98 and 156, and 100 and 154, and respectively associated uni-torque nuts 172, 174 and 176, flat washers being provided as suitable.

In accordance with the invention the several cap screws and nuts holding the plow blade center section 112 to the push frame 16 are tightened sufficiently to hold these members snugly together thereby providing firm support for the plow blade 118 over a substantial portion of the rear surface of the center section 112, but allowing limited relative pivotal movement of the center section 112 with respect to the push frame 16 about the pivot of bearings 102 and 160. The manner in which such pivotal movement is effected is described hereinafter.

Figure 10:
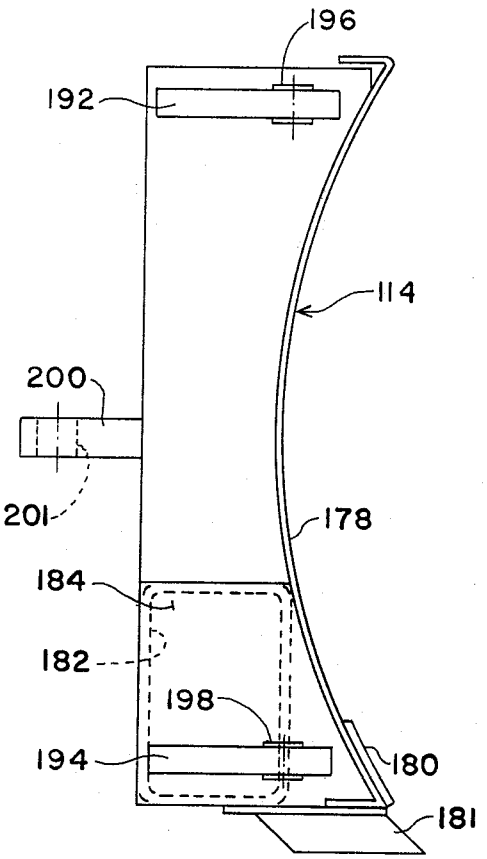
FIG. 10 is a diagrammatic end view of the right-hand wing blade section, as seen from the right in FIG. 8.
Figure 9:
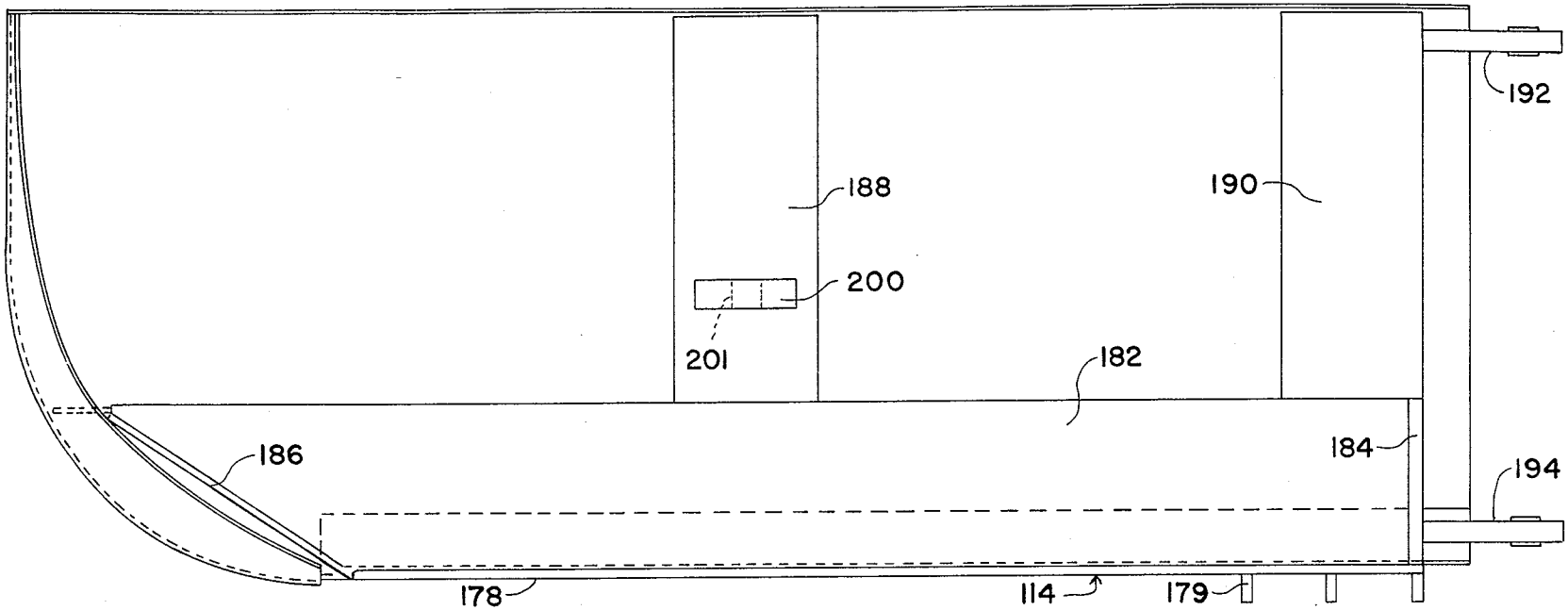
FIG. 9 is a diagrammatic rear view of the right-hand wing blade section of the variable wing plow blade of FIG. 2.
Figure 8:
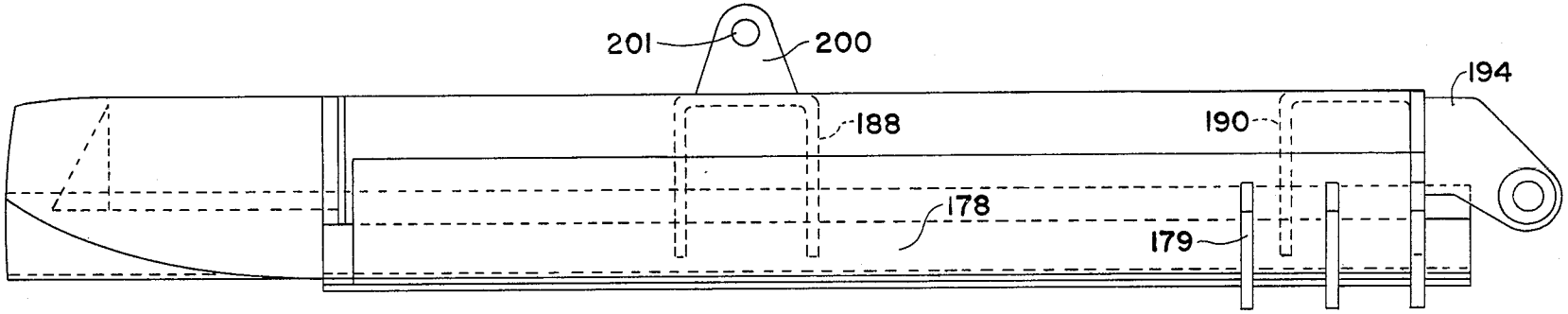
FIG. 8 is a diagrammatic bottom plan view of the right-hand wing blade section of the variable wing plow blade of FIG. 2.

The plow blade wing sections 114 and 116 may be of identical structure but opposite hands. Hence, for purposes of illustration, there is described by reference to FIGS. 8, 9 and 10 the right wing section 114 only. The wing section 114, as shown particularly in FIG. 10, includes a blade 178, the curvature of which corresponds to that of center blade 118. At the lower front edge the blade 178 is provided with an elongated angle iron or wear bar 180 including a snow blade tooth 181. Blade 178 is supported at the lower rear side by a generally rectangular elongated tube 182 the ends of which are closed by plates 184 and 186. Provided on and supported by the upper surface of tube 182, as seen in FIGS. 8 and 9, are two upstanding U-shaped frame members 188 and 190. An upper pivot arm 192 is attached to the inboard side of U-shaped member 190 and a lower pivot arm 194 is attached to the adjacent closure plate 184. Pivot arms 192 and 194 are each provided with a respective bearing 196 and 198. Additionally, a rearwardly extending pivot arm 200 having a bearing 201 is provided on U-shaped member 188.

It will be understood that the several structural members or components of which the center blade section 112 and the wing blade sections 114 and 116 are formed may be attached to each other in any suitable manner as by welding, for example, to the end that each section in practice, is made to comprise a unitary rigid structure. When formed of materials conventional for the purpose the center blade 112 and the wing blades 114 and 116 may be made to embody the necessary and desired strength required for material treating or handling plows.

The wing blade section 114 is hinged to the right end of center blade section 112, as seen in FIG. 2, by placing the upper pivot arm 192 between the upper hinge pads 142 of the center blade section, placing the lower pivot arm 194 between the hinge pads 144, and as indicated in FIG. 6, inserting a hinge pi 202 and 204 through the respectively associated bearings.

Figure 13:
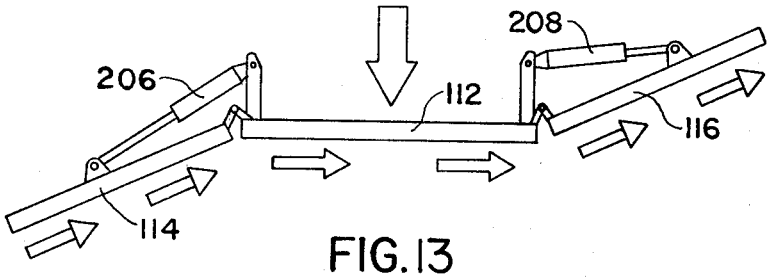
Figure 14:
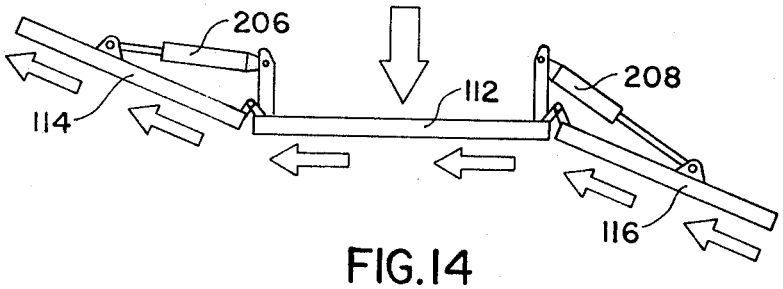
Figure 15:
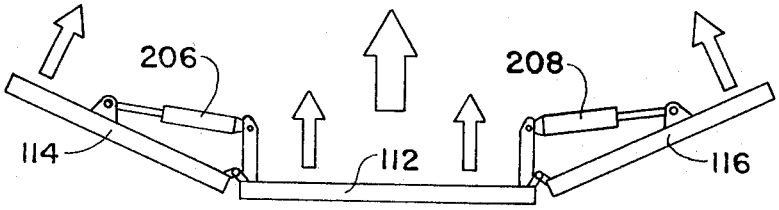

As seen in FIG. 2, a hydraulic motor 206, comprising a cylinder and ram, has one end connected to the pivot arm 200 of the wing blade section 114 and the other end connected to the pivot arm 148 of the center blade section 112. Hydraulic motor 206 is operative when actuated to move the wing blade section 114 with respect to the center blade section 112 in a generally horizontal plane about the vertical pivotal axis provided by the hinge pins 202 and 204 from a position in which the center and wing blade sections are in alignment, as illustrated in FIG. 1, to positions in which the wing blade section 114 is moved forwardly of the center blade section 112, as shown in FIG. 13, and in which the wing blade section 114 is moved rearwardly of the center blade section 112, as shown in FIG. 15. A hydraulic motor 208 which may be identical to the motor 206 is connected in a similar manner between the left wing section 116 and the center blade section 112 for effecting forward and rearward movements of the wing blade section 114, as seen in FIG. 2, with respect to center blade section 112, from a position of alignment therewith.

Figure 11:
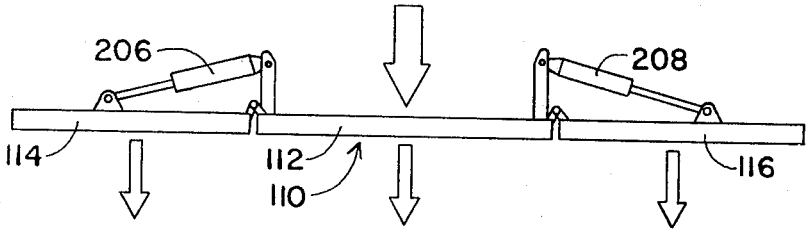
FIGS. 11 through 15 are schematic representations of the variable wing plow blade of the present invention, the several views illustrating typical controlled positions to which the wing blade sections may be moved with respect to the center blade section.
Figure 12:
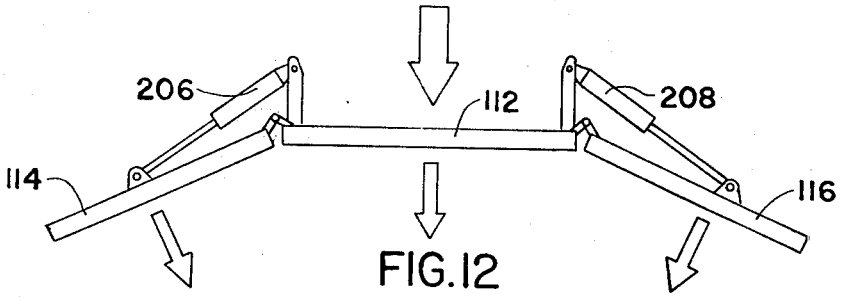

FIGS. 11–15 illustrate typical ones of a wide range of positions to which each of the wing blades or sections 114 and 116 can be adjusted in a generally horizontal plane with respect to the center blade section 112, from a rear angle position to a forward angle position. Thus, with both wing blades 114 and 116 parallel to or in alignment with the center blade 112, the variable wing plow blade 110 is operative as a straight plow blade, as shown in FIG. 11. With both wing blades 114 and 116 angled forward in the direction of movement of the vehicle, as shown in FIG. 12, the variable wing plow blade 110 is operative as a conventional U-blade for pushing forward the material being handled. With wing blade 114 angled forward and wing blade 116 angled backward, as shown in FIG. 13, the variable wing plow blade 110 is operative to move the material being handled to one side of the vehicle. In this condition of adjustment, snow, for example, can be transferred from the edges to the centers of narrow trails. In order to transfer the material to be handled to the opposite side of the vehicle, the wing blades 114 and 116 may be adjusted to the positions illustrated in FIG. 14. With the wing blades 114 and 116 in the positions illustrated in FIG. 15, the variable wing plow blade 110 is operative to drag the material being handled backwards when the vehicle is moving in reverse. This latter condition of adjustment is particularly advantageous for clearing or cleaning out ditches or culverts into which it is not practical for the vehicle to enter for pushing the material out.

In accordance with the invention the hydraulic motors 206 and 208 are controlled from a central control panel preferably provided in the cab of the vehicle for easy access by the operator. Also, in accordance, with the invention, additional hydraulic motor means controlled from the same central control panel may be provided for effecting the desired tilt angle, pitch angle and height adjustments of the variable wing plow blade 110. Specifically, for varying the tilt angle, there is provided, as shown in FIG. 1, a hydraulic motor 210 having a cylinder and ram with one end connected by a clevis to the pivot arm 108 on the end of the push frame 16 and the other end connected by a clevis to the bearing 152 on the U-shaped frame 150 of the center blade section 112.

For varying the height of the variable wing plow blade 110 off the ground, there is provided two hydraulic motors 212 and 214 each having a cylinder and ram. Motor 214, as seen in FIGS. 1 and 3, has one end connected by a clevis to bearing 80 in pivot mount 60 of mount frame 14 and the other end connected by a clevis to a mounting plate 216 that is bolted in any suitable manner to the side of vehicle chassis 32. Motor 212, as best seen in FIG. 2, has one end connected to the bearing 78 in pivot mount 58 of mount frame 14 and the other end connected by a clevis to a mounting plate 218 that is bolted in any suitable manner to the side of the vehicle chassis 32 opposite that to which mounting plate 216 is attached. Upon actuation, motors 212 and 214 raise or lower frames 12, 14 and 16 as a unit and thereby the variable wing plow blade 110 about the axis of pivot arms 43 and 44 at the forward ends of the pivot mounts 34 and 36.

In order to vary the pitch angle of the plow blade there is provided a pair of hydraulic motors 220 and 222 and a pair of respectively associated extension arms 224 and 226. Each of the motors include a cylinder and ram for added rigidity and strength is telescoped within the forward end of its associated arm. One end of the motor 222, as seen in FIGS. 1 and 2, is connected to the bearing at the upper end of upstanding member 88 of the second frame means or push frame 16 and the other end is connected by a pin indicated at 228 in the adjacent end of the extension arm 224. The other end of extension arm 226 is attached by a mounting pin 230 to an anchor pad 232 that is bolted to the side of the vehicle chassis 32, above the hydraulic motor mounting plate 216 and further to the rear of the vehicle.

Similarly, one end of hydraulic motor 220, as seen in FIG. 2, is connected by a clevis to the bearing 104 at the upper end of upstanding member 86 of the push frame 16, the other end of motor 220 being connected by a pin 234 to the extension arm 226 near one end thereof. The other end of extension arm 226 is attached by a mounting pin 236 to an anchor pad 238 that is bolted on the other side of the vehicle chassis 32, at a position substantially directly opposite the position at which anchor pad 232 is bolted to the chassis 32.

Actuation of hydraulic motors 220 and 222 is in unison. Upon such actuation the push frame 16 and thereby the variable wing plow blade 110 are tipped forwardly or backwardly about the axis of the pivot bearings 62, 66 or 64, 68 in the pivot mounts 58 and 60 to position the plow blade to the desired pitch angle position. With the length of each of the arms 224 and 226 selected to form a parallelogram with the combined length of frames 12, 14 and 16, such adjusted pitch angle of the plow blade is not changed upon variation in the height above the ground of the plow blade.

In general the fluid supply means, the hydraulic piping or circuitry, and the control panel means for selectively actuating the several hydraulic motor means form no part of the present invention and have not been illustrated in order to avoid undue complication of the drawing. The invention features, however, the use of relief valve means in connection with the hydraulic motors 206 and 208 provided for actuating the wing blades 116 and 114, respectively, for releasing pressure in the associated hydraulic motor cylinder in the event either wing blade hits an immovable object while the vehicle is in motion. Upon such release in pressure in the hydraulic cylinder, the associated wing blade is allowed to deflect around it hinge connection to the center blade 112, thereby avoiding damage to the wing blade and also to the center blade.

Figure 16:
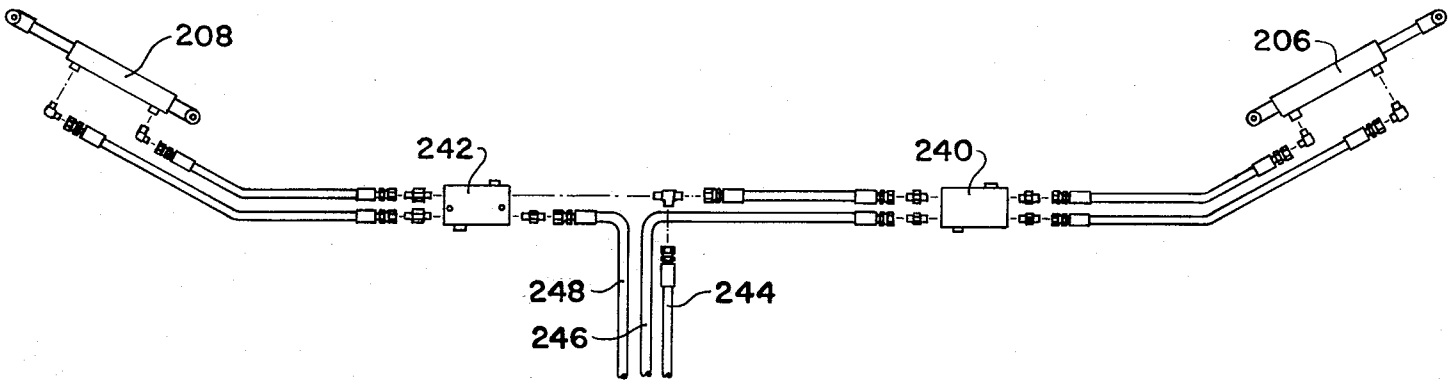
FIG. 16 is a partial schematic piping diagram, including relief valve means, for controlling hydraulic motor means provided for actuating the wing blades of the variable wing plow blade.

Specifically, there are provided relief or cushion valves 240 and 242 in the hydraulic fluid line connections 244, 246 and 248 to the hydraulic motors 206 and 208, as illustrated in FIG. 16. Relief valves 240 and 242 may be of known type, and for example, may each comprise a Vickers relief valve, a balanced piston type relief valve with piston of equal areas on both sides and which provides for the escape of hydraulic fluid directly to the tank in the event of excessive fluid pressure in the lines to motors 206 and 208. As shown in FIG. 16, fluid line 244 is a common line connected through both of relief valves 240 and 242 to one fluid input of both of the hydraulic motors 206 and 208. Line 246 is connected through relief valve 240 to the other fluid input of motor 206. Similarly, line 248 is connected through relief valve 242 to the other fluid input of motor 208. It is believed that the operation of the relief valves in releasing pressure in the associated motor in the event that either wing blade 114 and 116 hits an immovable object will be apparent to those skilled in the art.

Thus, there has been provided in accordance with the invention a novel variable wing plow blade and a novel mounting structure or assembly therefor that avoids the problems and limitations of the prior art blades and mounting structures or assemblies. The novel mounting assembly provides the essential structural strength required while permitting a reduction in the size, weight and number of components required, thus achieving a desired reduction in cost of manufacturing and assembly. The assembly further provides improved performance in respect of rendering substantially independent of each other the height and pitch angle adjustments of the plow blade. Additionally the assembly and novel plow blade provide greater freedom of movement of the plow blade with respect to the assembly that is possible with the prior art constructions, including movement, both independently of each other and with respect to the center blade, of the wing blades, rearwardly as well as forwardly of the center blade. Motor means comprising double acting hydraulic cylinders or jacks enable the various plow blade adjustments to be made from a control panel in the cab, relief valve means being provided for avoiding damage in the event either wing blade hits an immovable object while the vehicle is in motion.

What is claimed is:

1. A variable wing plow blade and mounting structure therefor comprising, a variable wing plow blade having a center blade and a pair of wing blades each of which is connected at one end by a generally vertical hinge to a respectively associated end of said center blade and is provided with a rearwardly extending first pivot arm from an intermediate position thereof, said center blade including a separate rearwardly extending second pivot arm adjacent each end thereof, first and second motor means connected respectively between each of said first pivot arms and associated one of said second pivot arms for effecting relative angular adjustment of each of said wing blades with respect to said center blade both forwardly and rearwardly with respect to a position of alignment therewith, first frame means having a forward and and rearward end and adapted for attachment at the rearward end to a vehicle, second frame means adjacent the forward end of said first frame means and generally vertically disposed with respect to said first frame means, first connecting means including at least one upper and at least one lower pivot connection position for connecting the forward end of said first frame means to the lower end of said second frame means, said first connecting means pivotally connecting the forward end of said first frame means to the lower end of said second frame means about an axis that is generally horizontal and parallel to the planes of said second frame means and center blade, said first connecting means including a pair of first pivot mounts, one being provided at each forward side of said first frame means, and clevis means associated with said pivot mounts and provided on the side of said second frame means remote from said center blade, means for attaching said center blade of said variable wing plow blade to said second frame means, the attachment being such as to restrain relative movement about any axis that is parallel to the planes of said center blade and said second frame means, and said attaching means includes second connecting means for pivotally connecting said center blade to said second frame means about an axis that is substantially normal to the axis of said first connecting means.

2. A variable wing plow blade and mounting structure therefor as specified in claim 1 including second pivot mounts for pivotally connecting the rearward end of said first frame means to the vehicle about an axis that is generally horizontal and parallel to the longitudinal plane of said second frame means, and third and fourth motor means connected respectively between each of said first pivot mounts and the vehicle for pivoting said first and second frame means and thereby said variable wing plow blade about the horizontal axis of said second pivot mounts.

3. A variable wing plow blade and mounting structure therefor as specified in claim 2 wherein said center blade includes at an upper portion thereof a rearwardly extending member, said second frame means includes at the lower end a pivot arm that extends to one side in the longitudinal plane thereof, and including fifth motor means connected between said last mentioned pivot arm and said rearwardly extending member of said center blade for tilting the said center blade relatively to said second frame about the axis of said second connecting means.

4. A variable wing plow blade and mounting structure therefor as specified in claim 1 wherein said second frame means includes an integral upstanding member at each of the sides thereof, and including sixth and seventh motor means adapted to be connected respectively between each of the upper ends of said upstanding members and the vehicle to pivot said second frame means and thereby said variable wing plow blade with respect to said first frame means about the axis of said first connecting means.

5. A variable wing plow blade and mounting structure therefor as specified in claim 4 wherein each one of said motor means comprises a hydraulic cylinder and ram.

6. A variable wing plow blade and mounting structure therefor as specified in claim 1 including relief valve means for releasing the pressure in said first and second motor means in the event either of said wing blades hits an immovable object.

7. A plow device comprising an elongated center blade and first and second wing blades, each of said center and wing blades having working services adapted to contact a substance to be plowed, said wing blades each being generally vertically pivotally connected at one end to a respectively associated end of said center blade for forward and rearward angular adjustment in position with respect to a position of alignment thereof with said center blade and each including a separate first pivot arm extending rearwardly from an intermediate position thereof, said center blade including a separate rearwardly extending second pivot arm adjacent each end thereof, each of said first and second pivot arms providing a generally vertical pivot connection, and first and second control means connected, respectively, between an associated one of the vertical pivotal connections of said second pivot arms and an associated one of the vertical pivotal connections of said first pivot arms, said plow device further including, a generally vertically positioned mounting frame having mounting means for mounting said center blade on said frame in generally parallel relation thereto, said mounting means including spaced rearwardly extending clevis means, and generally horizontal frame means having a forward end and a rearward end and having at its forward end spaced pivot arm extensions including at least one upper and at least one lower connection position that is connected to said center blade.

8. A plow device as specified in claim 7 wherein each of said first and second control means is operative independently of the other whereby each of said first and second wing blades is angularly adjustable in position with respect to said center blade independently of the other.

9. A plow device as specified in claim 8 wherein each of said control means includes a hydraulic cylinder and ram.

10. A plow device as specified in claim 7 wherein said mounting frame includes a generally horizontal pivot means that extends along an axis transversely of said center blade and mounting frame whereby to provide for relative angular adjustment of said center blade and mounting frame.

11. A plow device as specified in claim 3 wherein said transverse pivot means is generally centrally located with respect to said center blade and said mounting frame, said mounting frame includes a first pivot arm extending parallel thereto, said center blade includes a third pivot arm that extends rearwardly thereof, said mounting frame first pivot arm and center blade third pivot arm being spaced generally vertically from each other and each providing a generally horizontal pivot connection transverse to said center blade and mounting frame, and third control means connected between said mounting frame first pivot arm and said center blade third pivot arm for controlling the relative angular adjustment of said center blade with respect to said mounting frame.

12. A plow device as specified in claim 5 wherein said third control means includes a hydraulic cylinder and ram.

13. A plow device as specified in claim 4 wherein said transverse pivot means comprises a pivot pin that pivotally connects said center blade and mounting frame at a position substantially in horizontal alignment with said mounting frame first pivot arm, wherein said mounting means includes at least one curved slot the curvature of which corresponds to that of the arc of the circle having said pivot pin at its center, and wherein said center blade is further connected to said mounting frame by at least one pin connection of said center blade to said curved slot.

14. A plow device as specified in claim 6 wherein said mounting means includes a plurality of curved slots the curvatures of each of which correspond to that of the arc of a circle having said pivot pin at its center, and wherein said center blade is connected to said mounting frame by additional pin connections of said center blade and said curved slots.

15. A plow device as specified in claim 4 wherein said mounting frame and said center blade each include at least one curved slot facing each other, the curvature of each of said slots corresponding to that of the arc of the circle having said pivot means at its center, and wherein said center blade is further connected to said mounting frame by pin connection of said facing curved slots.

16. A plow device as specified in claim 1 further including pivot mount means having a forward end and a rearward end, said rearward end being adapted for bolting to a tractor, said horizontal frame means further including pivot means at the rearward end thereof that connect the rearward end of said frame means to the forward end of said pivot mount means.

17. A plow device as specified in claim 1 further including spaced first tractor mount means that provide a generally horizontal pivot connecting means rearward of and along an axis parallel to said center blade and mounting frame, and wherein said pivot arm extensions of said horizontal frame means further provide generally horizontal second pivot means along an axis parallel to said center blade and mounting frame, and a separate control means connected between each of said spaced tractor pivot connecting means and said second pivot means.

18. A plow device as specified in claim 1 further including spaced second tractor mount means that provide generally horizontal pivot connecting means rearward of and along an axis parallel to said center blade and mounting frame, and wherein said mounting frame further includes generally vertically extending pivot arms that provide generally horizontal third pivot connecting means that extend along an axis parallel to said center blade and mounting frame, and a separate control means connected between the pivot connecting means provided by said spaced second tractor mount means and said third pivot connecting means.

19. A plow device as specified in claim 16 further including spaced first tractor mount means that provide generally horizontal second pivot connecting means rearward of and along an axis parallel to said center blade and mounting frame, and wherein said mounting frame further includes generally vertically extending spaced pivot arms that provide generally horizontal third pivot connecting means that extend along an axis parallel to said center blade and mounting frame, and a separate control means connected between each of said second and third pivot connecting means, each of said last mentioned control means comprising a roll control means and including an extension arm.

20. A plow device as specified in claim 11 further including spaced second tractor mount means that provide generally horizontal fourth pivot connecting means rearward of and along an axis parallel to said center blade and mounting frame, wherein each of said pivot arm extensions of said horizontal frame means further provide generally horizontal fifth pivot connecting means along an axis parallel to said center blade and mounting frame, and further including a separate control means connected between each of said fourth pivot connecting means and said fifth pivot connecting means, each of said last mentioned control means comprising a lift control means for raising and lowering said center blade with respect to said pivot mount means.

21. A plow device as specified in claim 11 wherein the spacing between said second and third pivot connecting means is substantially the same as that between said mount frame rearward and forward pivot connecting means whereby substantially no change occurs in the pitch angle of said center blade upon actuation of said lift control means.

* * * * *

UNITED STATES PATENT AND TRADEMARK OFFICE

CERTIFICATE OF CORRECTION

PATENT NO. : 4,249,323

DATED : February 10, 1981

INVENTOR(S) : Robert D. Mathis et al.

It is certified that error appears in the above—identified patent and that said Letters Patent is hereby corrected as shown below:

Column 12, line 36, "claim 1" should read -- claim 3 --.

Column 13, line 31, "claim 3" should read -- claim 10 --.

Column 13, line 46, "claim 5" should read -- claim 11 --.

Column 13, line 49, "claim 4" should read -- claim 11 --.

Column 13, line 59, "claim 6" should read -- claim 11 --.

Column 13, line 66, "claim 4" should read -- claim 11 --.

Column 14, line 5, "claim 1" should read -- claim 7 --.

Column 14, line 12, "claim 1" should read -- claim 7 --.

Column 14, line 23, "claim 1" should read -- claim 7 --.

Column 14, line 47, "claim 11" should read -- claim 19 --.

Column 14, line 61, "claim 11" should read -- claim 20 --.

Signed and Sealed this

Ninth Day of June 1981

[SEAL]

*Attest:*

RENE D. TEGTMEYER

*Attesting Officer*

*Acting Commissioner of Patents and Trademarks*